United States Patent [19]

Watanabe

[11] Patent Number: 4,976,650

[45] Date of Patent: Dec. 11, 1990

[54] DEVICE FOR STARTING A TOY

[75] Inventor: Hiroyuki Watanabe, Tokyo, Japan

[73] Assignee: Tomy Kogyo Co., Inc., Tokyo, Japan

[21] Appl. No.: 421,996

[22] Filed: Oct. 16, 1989

[30] Foreign Application Priority Data

Dec. 16, 1988 [JP] Japan ..... 63-163347

[51] Int. Cl.[5] ..... A63H 5/00; A63H 29/24; A63H 17/34

[52] U.S. Cl. ..... 446/418; 446/414; 446/144; 446/462; 446/463; 446/484

[58] Field of Search ..... 446/397, 409, 418, 420, 446/436, 462, 463, 464, 144, 145, 414, 484

[56] References Cited

U.S. PATENT DOCUMENTS

| | | | |
|---|---|---|---|
| 3,797,163 | 3/1974 | McRoskey et al. | 446/145 |
| 4,135,328 | 1/1979 | Yamasaki | 446/463 |
| 4,553,947 | 11/1985 | Weiland et al. | 446/463 X |
| 4,573,943 | 3/1986 | Kennedy et al. | 446/463 |
| 4,580,994 | 4/1986 | Fauser et al. | 446/462 X |

FOREIGN PATENT DOCUMENTS

| | | | |
|---|---|---|---|
| 2090757 | 7/1982 | United Kingdom | 446/145 |

*Primary Examiner*—Mickey Yu

*Attorney, Agent, or Firm*—Staas & Halsey

[57] ABSTRACT

A starter device for a toy drive mechanism that simulates manual starting of a small engine. The starter device includes an input mechanism, operable by a user, for providing a first drive force; a memory mechanism for storing the number of operations of the input mechanism by the user; a sound generating mechanism for producing sounds in response to at least one of the first drive force and a second drive force; a motor mechanism for providing the second drive force in response to at least one of an intermittent input and the number of operations of the input mechanism being a predetermined number; and a mechanism for providing the intermittent input based on operation of said input mechanism and on the second drive force.

9 Claims, 4 Drawing Sheets

DEVICE FOR STARTING A TOY

BACKGROUND OF THE PRESENT INVENTION

The present invention relates to a starter device for a drive mechanism in a toy and; more particularly, to a starter device wherein a toy engine can be started by pulling on a rope.

Starting a single or two cylinder engine by rotating the crank shaft thereof by pulling a rope is well known. However, conventional wisdom indicates that it is not necessary to use such a cumbersome starter device if an electric motor drive mechanism is used since such a motor can be satisfactorily operated by closing a power source switch. However, for various vehicles driven by an engine, (e.g. outboard engines, mowers or the like), the start of an engine is an important procedure. In this regard, pulling on the rope to start an engine has traditionally been regarded as an integral part of using such powered devices. The present invention incorporates rope pulling to start a toy so as to enhance the play value of the toy.

SUMMARY OF THE INVENTION

Accordingly, it is an object of the present invention to provide a starter device for a toy engine which mimics real life starter devices for engines.

It is another object of the present invention to provide a starter device for a toy engine which enhances the play value of the toy.

It is a further object of the present invention to provide a starter device for a toy engine which heightens a user's interest in the toy.

To achieve the foregoing and other objects of the present invention there is provided a drum member journalled to a rotary shaft that is rotatably mounted on a frame; a rope having an outer end with a grip; the rope being locked to the drum member; and a return spring disposed to urge the rope in a winding direction. A gear adapted to be rotated a predetermined angle by pulling the above-mentioned rope is loosely fitted on one of end of the rotary shaft, and a projection adapted to be engaged with a rotary lever for opening a main switch each time it rotates by one revolution is provided on the gear. A base of a rotary arm having a forward end to which a rotary gear meshed with the gear journalled to the rotary shaft is fitted is loosely fitted to the other end of the rotary shaft, and therefore the rotary gear is rotated by pulling the grip so as to be engaged with a transmission gear in the above-mentioned drive mechanism to actuate a starter switch, thereby the drive mechanism is driven for a short time. The drum member is rotated by pulling the grip so as to rotate the rotary gear attached to one end of the rotary shaft to which the rotary drum is journalled and is meshed with the transmission gear in the drive mechanism to actuate the starter switch. The starter switch is adapted to close a contact for a short time. Simultaneously, the gear loosely fitted on the rotary shaft and having the projection is rotated by a predetermined angle by one motion for pulling the grip. Further, when the grip is pulled, the gear mounted on the rotary shaft is rotated by one revolution so that the engaging projection is engaged with the rotary lever which is therefore rotated to close a main switch, thereby driving the drive mechanism continuously.

To achieve the above and other objects, the present invention also provides a starter device for a toy drive mechanism that simulates manual starting of a small engine. The starter device includes an input mechanism, operable by a user, for providing a first drive force; a memory mechanism for storing the number of operations of the input mechanism by the user; a sound generating mechanism for producing sounds in response to at least one of the first drive force and a second drive force; a motor mechanism for providing the second drive force in response to at least one of an intermittent input and the number of operations of the input mechanism being a predetermined number; and a mechanism for providing the intermittent input based on operation of said input means and on the second drive force.

Other features and advantages of the present invention will be apparent from the following description taken in conjunction with the accompanying drawings, in which like reference characters designate the same or similar parts throughout the figures thereof.

DETAILED DESCRIPTION OF THE PREFERRED EMBODIMENTS

Figure 12:
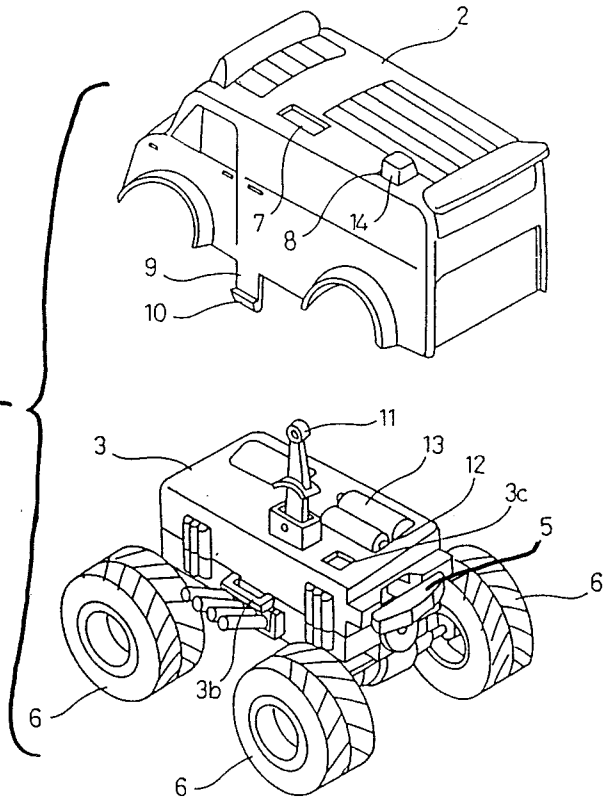
FIG. 12 is a perspective view illustrating the exterior the toy vehicle with the upper outer shell is removed.
Figure 10:
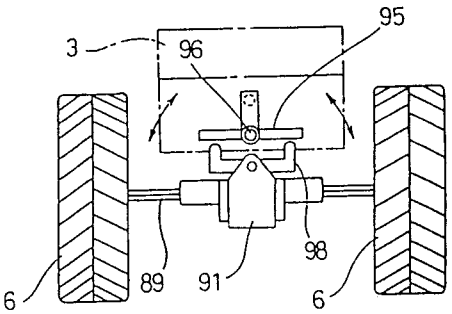
FIG. 10 is a front view illustrating a coupling condition between a frame and a drive axle.
Figure 11:
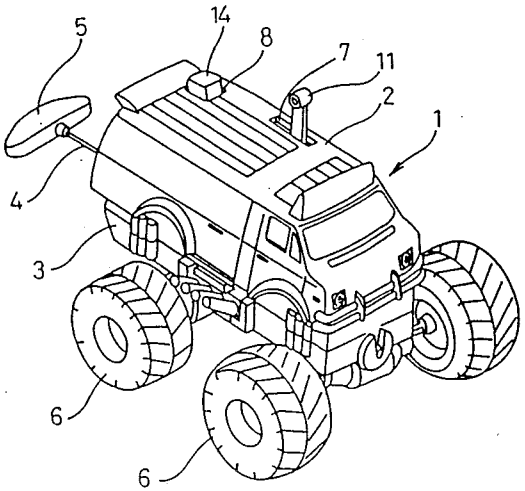
FIG. 11 is a perspective view illustrating the exterior of the toy vehicle body.

According to the present invention, a starter device for a drive mechanism can be incorporated in a toy such as a four wheel drive vehicle as shown in FIGS. 11 and 12. That is, a body 1 comprises an upper, outer shell 2 that is removably mounted on a frame or chassis 3. The upper shell 2 can have any shape such as an automobile or truck shape. Projecting pieces 9 suspended from the side walls of the upper shell 2 are formed at their lower ends with locking pawls 10 which fit in through-holes in locking members 3*b* formed on side surfaces of the frame 3. The upper shell 2 is thereby removably mounted to the frame 3.

The frame 3 can be formed in a box-like shape, and receives at an upper surface of a top wall thereof a manipulating lever 11 having one end projecting upwardly through an elongated hole 7 formed in the upper, outer shell 2. A battery storage section 12 is formed in the upper surface of the top wall at a suitable position, and batteries 13 are removably fitted therein. A through-hole 3c is formed in the upper surface of the top wall, and a push button 14 for stopping the drive mechanism described below, is movably disposed in the through-hole 3c. The upper part of the push button 14 projects upwardly through a through-hole 8 formed in the upper shell 2. Further, a grip 5 is connected to a rope 4 projecting from one end of the frame 3.

Next, the drive mechanism and the associated mechanism for operating the drive mechanism, both of which are disposed on the frame 3, will be explained with reference to FIGS. 1–3 and 9.

A rotary shaft 22 rotatably mounted on frame 3 is journalled at its center with a drum member 15 fitted onto a fitting member 15a. Further, an inner end of the rope 4 is connected to the drum member 15 while an outer end of the rope 4 is connected to a grip provided outside of the frame 3. A return spring 23 is resiliently disposed in the drum member 15. The spring 23 urges the drum in a direction so as to rewind the rope 4.

Figure 1:
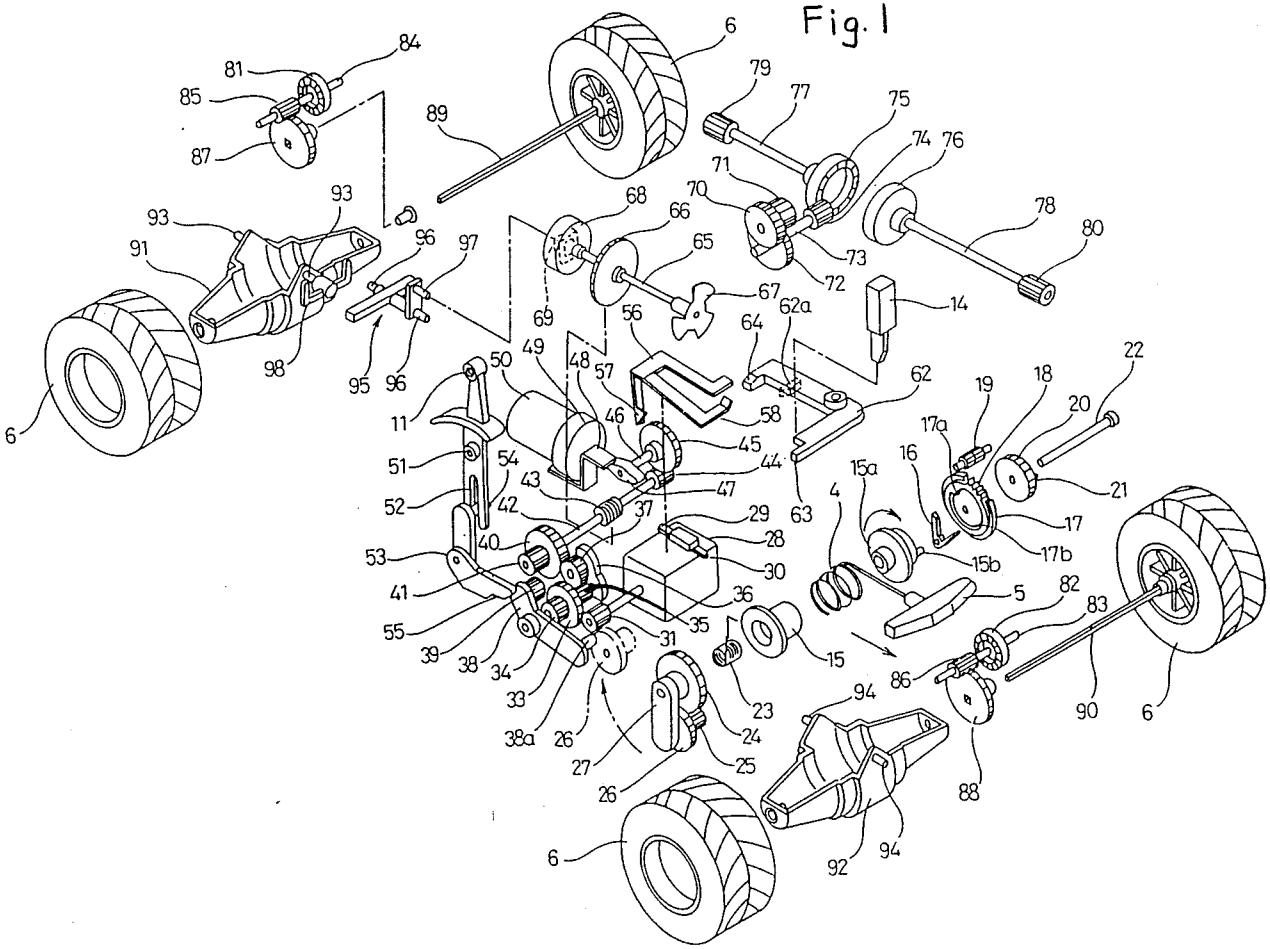
FIG. 1 is a perspective, exploded view of a toy including a drive mechanism according to the present invention.
Figure 9:
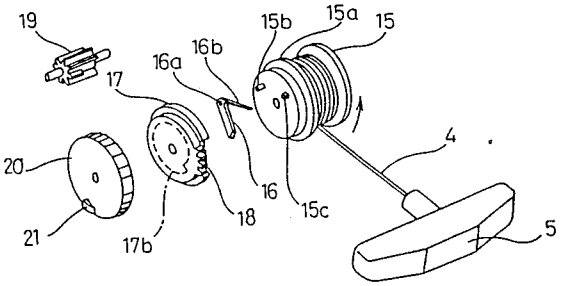
FIG. 9 is a perspective view illustrating parts of the drum member.

The fitting member 15a, as shown in FIG. 1 and enlarged in FIG. 9, has an end surface from which a support shaft 15b and a stopper 15c project. Further, the support shaft 15b fits in an axial hole 16a of a V-like swingable piece 16 which is therefore swingably journalled thereto. One end of the swingable piece 16 is formed as a thin wall resilient piece 16b for abutting the stopper 15c. Further, the swingable piece 16 fits in a recess 17b formed in an intermittent tooth gear 17 rotatably and loosely fitting on the rotary shaft 22.

Accordingly, when the drum member 15 is rotated clockwise as shown in FIG. 1 by pulling the grip 5, the forward end of the swingable piece 16 is engaged with an end face of a projection 17a in the recess 17b of the intermittent tooth gear 17 so as to rotate the intermittent tooth gear one revolution. When the drum member 15 is rotated counterclockwise by the return spring 23, the swingable piece 16 is engaged with an inclined surface of the projection 17a so that the resilient piece 16b is flexed to ride over the projection 17a. As a result, the swingable piece 16 functions as a clutch.

The intermittent tooth gear 17 is formed with four teeth 18 which are provided so that they can mesh with an intermediate gear 19. The intermediate gear 19 is journalled in an elongated hole (not shown) formed in the frame 3, has eight teeth which mesh with the teeth 18, and has two teeth (located at symmetrical positions) cut off or missing. The teeth of the intermediate gear 19 are adapted to mesh with a gear 20 loosely fitted on the rotary shaft 22 that has twenty eight teeth.

When the grip 5 is pulled to rotate the drum member 15, the teeth 18 of the intermittent tooth gear 17 engage the four teeth of the intermediate gear 19. Thus, the gear 20 meshed with the intermediate gear 19 is rotated by an amount corresponding to the four teeth. The intermediate gear 19, having been rotated by the four teeth 18, is engaged at its missed tooth gap with the outer periphery of the intermittent tooth gear 17 so that the gear 19 allows the intermittent tooth gear 17 to be rotated in its stopping condition. Further, when the grip 5 is pulled by seven times, the gear 20 is rotated by one revolution. Thus, intermittent tooth gear 17, the four teeth gear 18, the intermediate gear 19, and the gear 20 cooperate to perform the function of storing the number of times that the grip 5 is pulled.

A gear 24 is journalled to the other end of a rotary shaft 22. The base of a rotary arm 27 is rotatably and loosely fitted on the rotary shaft 22, coaxial with the gear 24. A gear 26 integrally formed thereon with a pinion 25 is rotatably journalled at the forward end of the rotary arm 27, the pinion 25 meshes with the gear 24.

When the grip 5 is pulled, the gear 24 is rotated clockwise as shown in FIG. 1. Accordingly the pinion 25 meshed with the gear 24, and the gear 26, are rotated counterclockwise as shown in FIG. 1. The rotary arm 27 attached thereto with the pinion 25 is thereby rotated in the direction of rotation of the gear 24, that is, the clockwise direction as shown in FIG. 1, and the gear 26 meshes with a motor pinion 31, which is a transmission gear in the drive mechanism.

Figure 6:
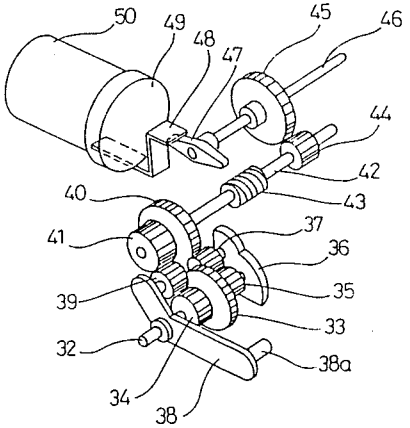
FIG. 6 is a perspective view illustrating part of the drive mechanism.
Figure 7:
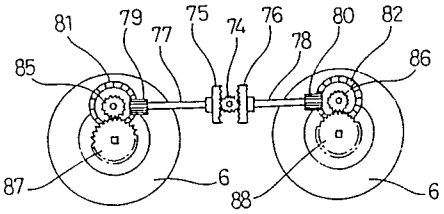
FIG. 7 is a lateral view illustrating a transmission mechanism.

Next, explanation will be made of the drive mechanism with reference to FIGS. 1 and 6 which best illustrate the drive mechanism.

The motor pinion 31 is journalled to the motor shaft of a motor 28 and meshes with a gear 33 journalled to a gear shaft 32. Pinions 34 and 35 are journalled to the gear shaft 32 on both sides of the gear 33. The pinion 34 always meshes with a pinion 39 journalled to one end part of a swingable lever 38 which is fitted, although loosely, on the gear shaft 32. The pinion 35 always meshes with a pinion 37 which is rotatably journalled to a rotary plate 36. The rotary plate 36 is rotatably and loosely fitted on the gear shaft 32. Further, the gear 33 meshed with the motor pinion 31 is rotated counterclockwise as shown in FIG. 1 when the motor 28 is driven. The pinions 34 and 35 rotate in the same direction.

Accordingly, the swingable lever 38, to which the pinion 39 that is meshed with the pinion 34 is journalled, experiences a torque in the counterclockwise direction about the gear shaft 32 which acts as a fulcrum. A pin 38a is formed on the other end of the swingable lever 38. The pin 38a engages a stepped part 55 formed at one end of an actuating lever 53 which in turn is coupled to the base of the manipulating lever 11. The rotary plate 36, to which the pinion 37 is journalled, experiences a counterclock torque about the gear shaft 32 that acts as a fulcrum. The pinion 37 meshes with a gear 40 journalled to a gear shaft 42. A pinion 41, which is journalled to one end of the gear shaft 42, is arranged so as to be tangential to the locus of rotation of the pinion 39 located on the swingable lever 38 and so as to engage the pinion 39. A worm gear 43 is journalled on a central portion of the gear shaft 42 so as to mesh with a worm wheel 66 journalled to a gear shaft 65. A pinion 44, which is journalled to the other end of the gear shaft 42, meshes with a gear 45 journalled to one end of a gear shaft 46. A pawl 47 is journalled to the other end of the gear shaft 46, and the forward end of the pawl 47 is adapted to engage a free end of a resilient piece 48 which is bent in a crank shape and that has a raised part. the raised part abuts a diaphragm 49 made of rubber-like material that covers one end of a resonant cylinder 50. Vibration of the diaphragm 49, caused the resilient piece 47 engaging the pawl 47 that is rotated at a high speed, is amplified through the resonant cylinder 50 so as to generate sound that imitates an engine.

The actuating lever 53 having the stepped part 55, to which the pin 38a on the swingable arm 38 is engaged, is swingably journalled in the frame 3. A pin 54 projects from the upper end of the actuating lever 53. The pin 54 fits in a groove 52 formed in the lower end of the manipulating lever 11. The manipulating lever 11 includes a pivot part 51 journalled to the frame 3 so as to be swingable and held at each of the positions shown in FIGS. 8A, 8B, 8C.

Figure 8:
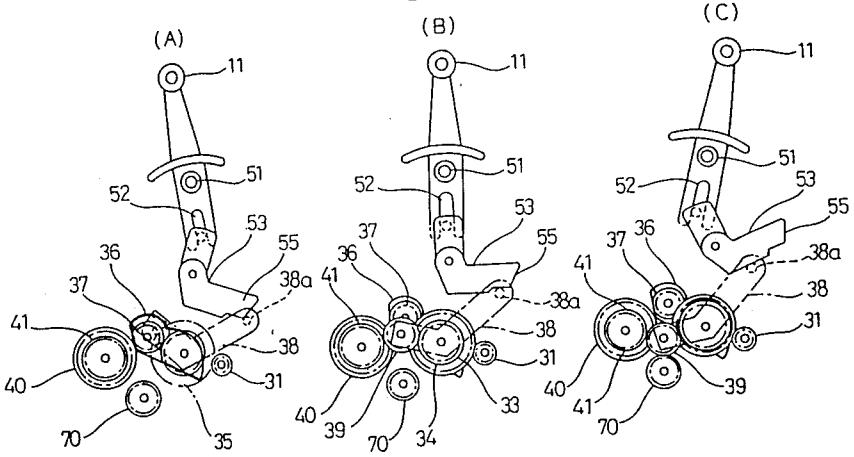
FIGS. 8(*a*)–8(*c*) are lateral views illustrating the drive mechanism operable in association with the manipulation of an actuating lever.

FIG. 8A illustrates a condition in which an upper end of the manipulating lever 11 is inclined forward relative to the driving direction of the body 1. The pin 38*a* on the swingable lever 38 is engaged with the engaging stepped part 55 of the actuating lever 53 which has been rotated clockwise, while the swingable lever 38 is rotated counterclockwise. At this time, the pinion 39 on the swingable lever 38 is separated from the pinion 41, the gear 40 is meshed with the pinion 37 on the rotary plate 36, and the gear shaft 42 is rotated at a relatively low speed so as to generate an engine sound representing an engine idling condition at a low rotational speed.

In a condition such as shown in FIG. 8B, the manipulating lever 11 is set in a neutral position. In this state, the swingable lever 38 is rotated counterclockwise slightly from the position shown in FIG. 8A so that the pinion 39 meshes with the pinion 41. Since the pinion 41 has a diameter that is smaller than that of the gear 40, the gear shaft 42 is rotated at a high speed so as to generate an engine sound representing an engine running at a high rotational speed. At this time, the pinion 37 of the rotary plate 36 cannot mesh with the gear 40 rotated at a high speed, and is therefore separated therefrom.

In a condition as such shown in FIG. 8C, the manipulating lever 11 is inclined backward. In this state, the swingable lever 38 is rotated counterclockwise further from the position shown in FIG. 8B. Further, the pinion 39, on the swingable lever 38, meshes with a gear 70 which transmits drive power to the pinion 41 and drive wheels 6. The body 1 is therefore driven so as to run with an engine sound being generated.

Figure 4:
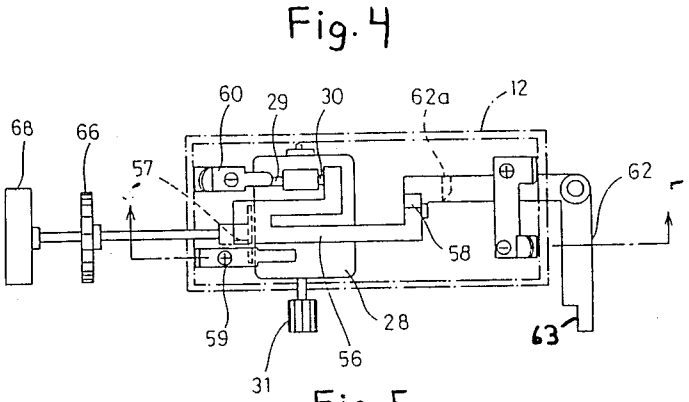
FIG. 4 is a plan view illustrating a switch mechanism.

Next, explanation will be made with reference to FIGS. 1, 4 and 5 of a starter switch and a main switch provided in association with the motor 28.

Figure 5:
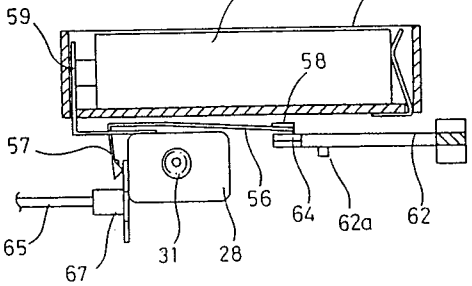
FIG. 5 is a lateral view taken along line 5—5 of FIG. 4.
Figure 2:
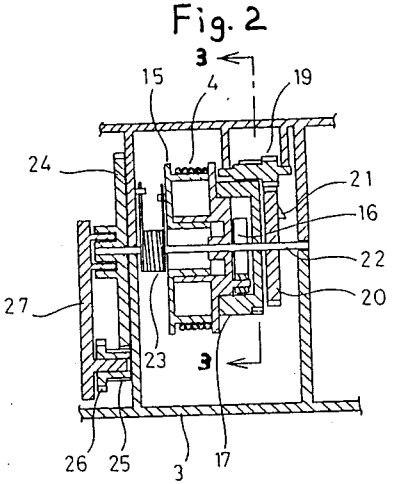
FIG. 2 is a transverse cross-sectional view of the starter device according to the present invention.
Figure 3:
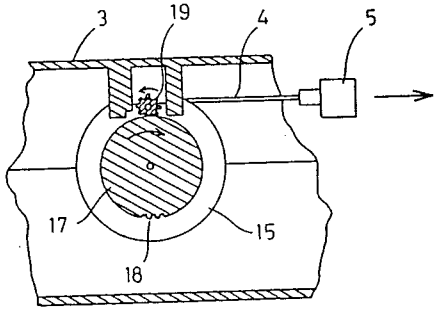
FIG. 3 is a cross-sectional view taken along line 3—3 of FIG. 2.

As shown in FIG. 5, the motor 28 is secured below the battery storage section 12 (which formed in the frame 13). One terminal, 29 (FIG. 4) of the motor 28 contacts conductive contact piece 60 which is an extension of one of the electrodes in the battery storage section 12. Another terminal, 30 of the motor 28 contacts one end of a conductive contact piece 56. A conductive contact piece 59, which is an extension of the other electrode in the battery storage section 12, contacts a conductive casing of the motor 28. The conductive contact piece 56 is formed with a contact piece which is bent in an L-like shape, and the latter has a forward end formed thereon with a projection 57. The conductive contact piece 56 is formed with a contact piece which extends obliquely downward, and the bent forward end is formed with an engaging piece 58. A rotary plate 67 journalled to one end of the gear shaft 65 and made of insulating material is inserted between the projection 57 on the conductive piece 56 and the casing of the motor 28. When a plurality of cut-out parts formed on the rotary plate 67 are rotated against the projection 57, the projection 57 contacts the casing of the motor 28 so as to close the starter switch.

When the above-mentioned push button 14 is depressed, an engaging piece 63, formed at one end of an L-like rotating lever 62, engages an inclined surface formed on the lower end of the push button 14 so that the rotary lever 62 is rotated counterclockwise. At this time an engaging piece 64, formed at the other end of the rotating lever 62, engages the engaging piece 58 of the conductive contact piece 56 so as to flex the conductive contact piece 56 upward. Accordingly, the contact piece 56, on which the engaging piece 58 is formed, is separated from the casing of the motor 28 as shown in FIG. 5, thereby opening the main switch.

Explanation will now be made of the operation of the drive mechanism, the starter switch and the main switch which are arranged as mentioned above.

At first, the manipulation lever 11 is inclined forward of the body 1 as shown in FIG. 8A, and the grip 5 projecting from the rear part of the frame 3 is pulled. When the grip 5 is pulled, the drum member 15, the rotary shaft 22 and the gear 24 rotate so that the rotary arm 27, on which the gear 26 that is coaxial with the pinion 25 and meshed with the gear 24 are arranged, rotates. The gear 26 therefore meshes with the motor pinion 31 which also rotates. Due to the rotation of the motor pinion 31, the worm wheel 66 meshed with the worm gear 43 and the rotary plate 67 are rotated. The projection 57 having been engaged with an insulating part of the rotary plate 67 is fitted in a cut-out part in the rotary plate 67 so as to make contact with the casing of the motor 28, thereby closing the starter switch. The motor 28 is driven for a certain time until the projection 57 makes contact with the next insulating part of the rotary plate 67, and simultaneously an engine sound is generated. The starter switch is thus closed in this manner (and power applied to the motor 28) for a limited number of rotations of the motor 28. In effect, the motor 28 shuts itself off after a short interval. This operation replicates a potentially troublesome start of an engine such as a single cylinder engine.

When the grip 5 is pulled, the intermittent tooth gear 17 rotates in association with the drum member 15 and the gear 20, and the intermediate gear 19 meshed therewith are rotated by predetermined angles, respectively. Due to the rotation of the gear 20, an engaging projection 21 projected from the gear 20 is engaged with an engaging projection 62*a* on the rotating lever 62 which is therefore rotated. Basically, in this mechanical embodiment, the engaging projection 21 functions as an output of the above-mentioned memory means. The output in this case is a mechanical force that acts on engaging projection 62*a* and cause the rotating lever 62 to rotate.

When the rotating lever 62 is rotated, the engagement between the engaging piece 64 and the engaging piece 58 of the conductive contact piece 56 is released, and the contact piece 56, in which the engaging piece 58 is formed, makes contact with the casing of the motor 28 so as to close the main switch. If the push button 14 is then depressed, the lower end of the push button 14 engages with the engaging piece 63 of the rotary lever 62. The rotary lever 62 is therefore rotated so that the contact piece 56, formed with the engaging piece 58, is separated from the casing of the motor 28 so as to open the main switch.

The gear 70, meshed with the pinion 39 attached to the swingable lever 38 to which drive power is transmitted by the motor 28, is arranged coaxially with a pinion 71, and is rotatably journalled to the frame 3. A gear 72 is journalled on a gear shaft 73 and meshes with the pinion 71. Crown gears 75 and 76 are journalled to ends of transmission shafts 77 and 78. The transmission shafts are laid longitudinally of the body 1 so that the crown gears 75 and 76 mesh with a pinion 74 journalled to the other end of the gear shaft 73. A pinion 79, journalled to the other end part of the gear shaft 77, meshes with a crown gear 81 journalled to a gear shaft 84 which is laid on the lower surface of the frame 3. A pinion 85 is also journalled on the gear shaft 84. A front wheel drive axle 89 is rotatably supported to a support frame 91 having support shafts 93 projecting longitudinally of the body 1 and rotatably journalled to the frame 3. A gear 87, disposed in the support frame 91 and journalled to the drive axle 89, meshes with the above-mentioned pinion 85 through an upper opening in the support frame 91. A U-like frame 98 projects from a casing for the support frame 91, having opening ends projecting on both sides of the support shaft 93 and abutting the lower surface of a piece 95 which is swingably supported to the frame 3 by means of support shafts 96. A pin 97 is formed on the upper part of one of the support shafts 96. The pin 97 fits in a cam groove 69 having a rectangular shape that is formed in the end surface of a cam plate 68. The cam plate 68 is journalled to one end of the gear shaft 65. Accordingly, when the motor 28 is driven, the cam plate 68 is rotated so as to swing the swingable arm 95, and since the opening ends of the U-like frame 98 abut the lower surface of the swingable arm 95, the frame 3 can be swung in the lateral direction. This simulates the vehicle shaking due to a rough ride or engine.

A mechanism for transmitting drive power to a rear wheel drive axle 90 is similar to that for the front wheel drive axle 89. That is, a pinion 80 journalled to one end of the transmission shaft 78 meshes with a crown gear 82 journalled to a gear shaft 83. A pinion 86 is journalled to the gear shaft 83 and meshes with a gear 88 that is journalled to the drive axle 90. A support frame 92 has support shafts 94 which are rotatably supported to the frame 3, in a manner similar to the support frame 91, and rotatably supports the drive axle 90.

Thus, as described above, the starter switch is actuated by manipulating the grip 5 projecting from the frame 3 constituting the body so that the drive mechanism is driven for a short time; and the main switch is actuated by pulling the grip 5 a predetermined number of times so that the drive mechanism is successively driven. This motion is indispensable for operating a single cylinder engine or the like, and is suitably used in a drive mechanism for a toy outboard engine, a toy mower or the like. It is therefore possible to provide a general purpose starter device for a drive mechanism. It should also be recognized by those skilled in the art that it is not necessary to the present invention that a rope be used. Any suitable manual operation can be used, such as a simulated kick start as is normally found on motorcycles. Those skilled in the art will also readily recognize that the present invention need not be embodied in mechanical form, but could also be embodied using simple electronic components such as a counter for counting a number of pulls on a rope together with a speaker for producing engine type sounds, and drive transistors to drive the motor.

The foregoing is considered illustrative only of the principles of the invention. Further, since numerous modifications and changes will readily occur to those skilled in the art, it is not desired to limit the invention to the exact construction and operation shown and described. Accordingly, all suitable modifications and equivalents may be resorted to that fall within the scope of the invention and the appended claims.

I claim:

1. A device for starting a toy comprising:

input means, operable by a user, for providing a first drive force;

memory means for storing the number of operations of said input means by the user;

sound generating means for producing sounds in response to at least one of said first drive force and a second drive force;

motor means for providing said second drive force in response to at least one of an intermittent input and the number of operations of said input means; and means for providing said intermittent input based on operation of said input means and on said second drive force.

2. A device according to claim 1, wherein said memory means comprises:

a first member, operatively connected to said input means such that an operation of said input means moves said first member by a desired amount.

3. A device according to claim 2, further comprising:

receiving means for receiving an electric potential, and wherein said motor means includes:

a DC motor;

a switch connected between said receiving means and said DC motor, and operatively connected to said first member such that the electric potential is applied to said DC motor when said first member is operated a predetermined number of times.

4. A device according to claim 3, further comprising:

another input means, operatively connected to said switch, for removing the electric potential from said DC motor in response to an operation of said another input means by the user.

5. A device according to claim 1, further comprising:

receiving means for receiving an electric potential, wherein said motor means includes a DC motor and wherein said means for providing said intermittent input includes:

a switch connected between said receiving means and said DC motor such that the electric potential is applied to said DC motor for a specified interval.

6. A device according to claim 5, wherein said switch includes:

a conductive path connected between said receiving means and said DC motor; and a first member positioned to be movable in response to said first drive force and positioned between said conductive path and said DC motor such that the electric potential is intermittently applied to said DC motor.

7. A device according to claim 1, wherein said sound generating means comprises:

a chamber;

a resilient member covering an end of said chamber; and a movable member positioned to strike said resilient member in response to at least one of said first drive force and said second drive force.

8. A device for starting a toy comprising:

a spring member biased in a wound position and movable by a user to an unwound position;

a first member operatively connected to said spring member such that movement of said spring member by the user causes said first member to move a desired amount;

first means for receiving an electrical potential;

a motor;

switch means for connecting said motor to said first means in a closed state and for disconnecting said motor from said first means in an open state;

a lever assembly positioned to cooperate with said first member so as to place said switch means in said closed state when said first member is moved a desired number of times; and a gear assembly positioned to cooperate with said spring member and said switch means so as to place said switch means in said closed state in response to the user moving said spring member, and positioned so as to place said switch means in said open state when said motor operates for a desired interval.

9. A device according to claim 8, further comprising:

another member, being movable by the user, and being positioned to movably cooperate with said lever assembly such that movable cooperation of said another member with said lever assembly places said switch means in said open state.

* * * * *